US006109709A

United States Patent [19]

Holcomb et al.

[11] Patent Number: 6,109,709

[45] Date of Patent: Aug. 29, 2000

[54] TOOL CABINET

[75] Inventors: Greg Jon Holcomb, Cedar Falls; Steven Frederick Kohagen, Waverly; Kent Charles Johnson, Cedar Falls; Robert J. Mehmen, Shell Rock, all of Iowa; Carl E. Hoffmeyer, Chicago, Ill.; Simon Yan, New York, N.Y.

[73] Assignee: Waterloo Industries, Inc., Waterloo, Iowa

[21] Appl. No.: 09/215,532

[22] Filed: Dec. 18, 1998

[51] Int. Cl.[7] ..... E05B 65/46

[52] U.S. Cl. ..... 312/218; 312/219; 312/217

[58] Field of Search ..... 312/217, 218, 312/219, 216, 222, 215, 221, 348.6, 249.8, 249.11, 249.12, 249.13, 282, 333, 280; 206/349, 373, 372; 16/416, 415, 110.1, 114.1; 70/85, 84, 78; 292/158, 167; 296/22; 280/47.35, 79.3

[56] References Cited

U.S. PATENT DOCUMENTS

| | | | |
|---|---|---|---|
| 2,711,944 | 6/1955 | Meek et al. . | |
| 4,057,306 | 11/1977 | Resch Jr. | 312/218 |
| 4,085,985 | 4/1978 | Weber | 312/218 X |
| 4,240,684 | 12/1980 | Henning | 312/215 X |
| 4,250,599 | 2/1981 | Nagashima et al. . | |
| 4,352,529 | 10/1982 | Steinke | 312/219 X |
| 4,804,876 | 2/1989 | Lannert et al. | 312/221 |
| 5,435,640 | 7/1995 | Holcomb . | |
| 5,720,535 | 2/1998 | Mehman | 312/219 |
| 5,740,910 | 4/1998 | Ueng | 206/373 |
| 5,862,689 | 1/1999 | Wen | 312/219 X |

FOREIGN PATENT DOCUMENTS

| | | | |
|---|---|---|---|
| 2446620 | 9/1980 | France | 312/222 |
| 2658076 | 7/1978 | Germany | 312/217 |

OTHER PUBLICATIONS

Drawer Retainer Drawing, Waterloo Industries, Inc. (Nov. 13, 1989).

Drawer Interlock Drawing, Waterloo Industries, Inc. (Mar. 4, 1991).

Drawer Installation Drawing, Waterloo Industries, Inc. (Jul. 23, 1979).

Roller Slide–LT Drawing, Waterloo Industries, Inc. (Jan. 8, 1991).

*Primary Examiner*—Janet M. Wilkens

*Attorney, Agent, or Firm*—Banner & Witcoff, Ltd.

[57] ABSTRACT

A combination cabinet and drawer construction includes a catch associated with the drawers that is cooperative with a biased, releasable locking bar. The locking bar is responsive to a cylinder lock actuated by a rod that engages the locking bar and rotates the bar to move it out of engagement with a leg of a drawer catch thereby releasing the drawer.

16 Claims, 10 Drawing Sheets

FIG.11
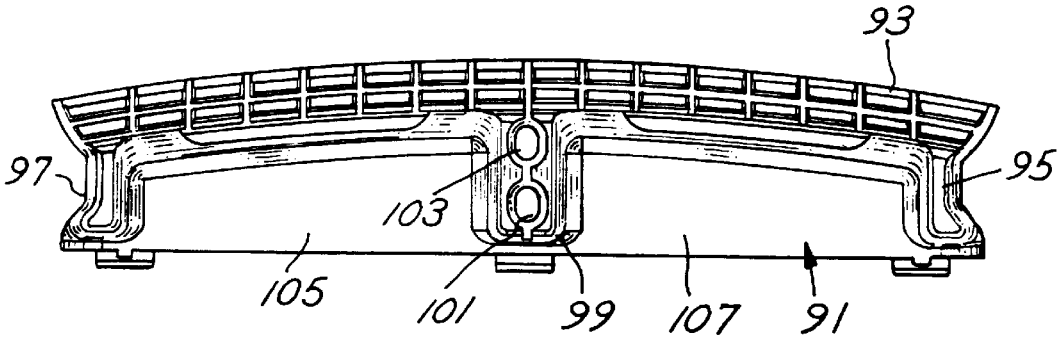
FIG.12
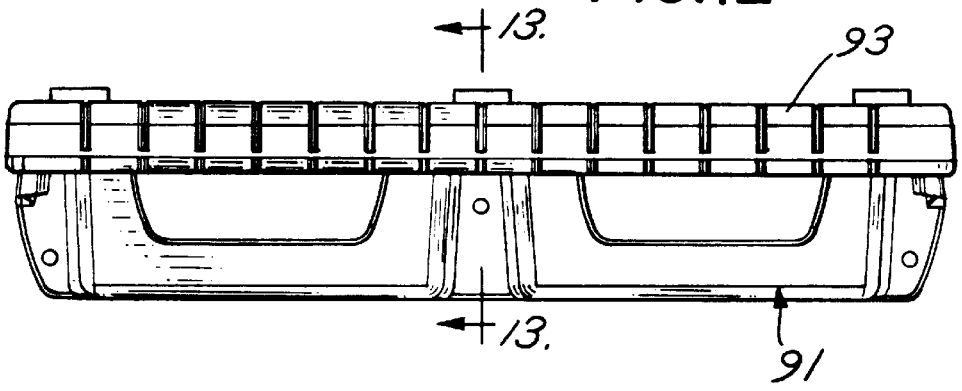
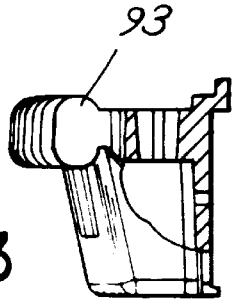
FIG.13

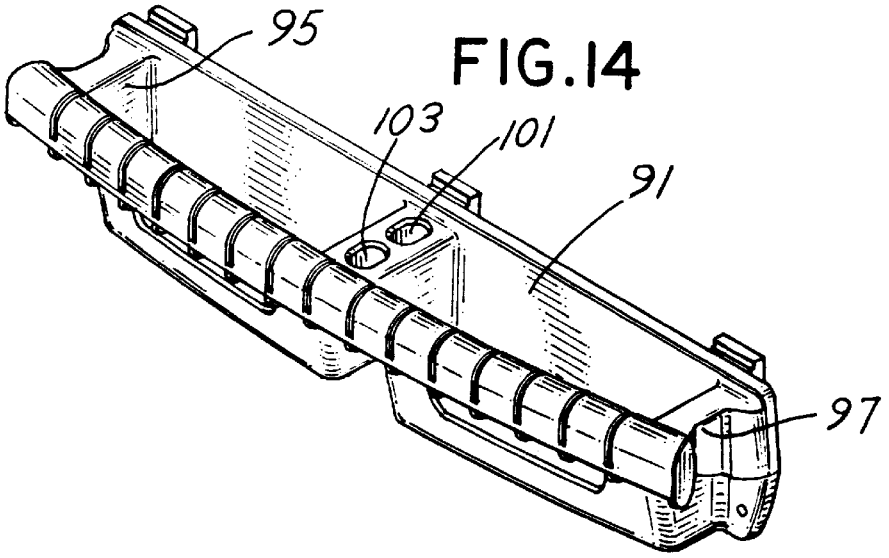
FIG.14
FIG.15
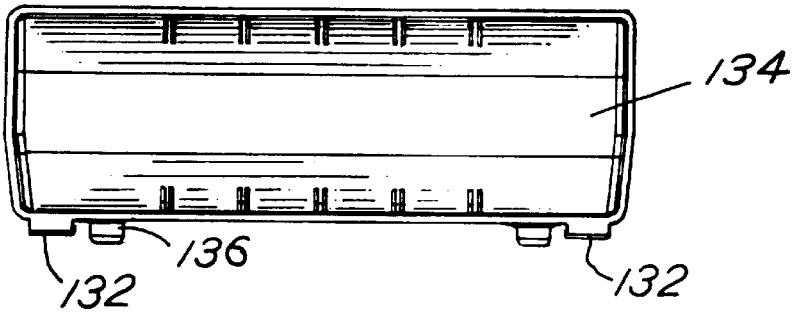
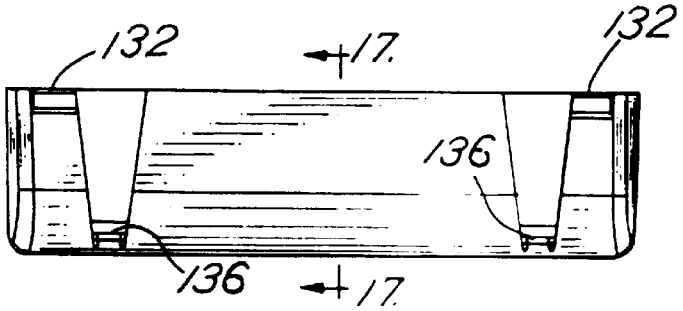
FIG.16
FIG.17
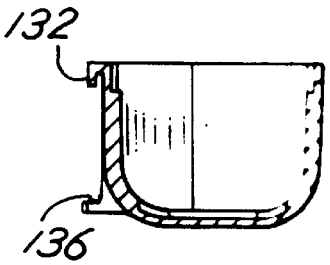

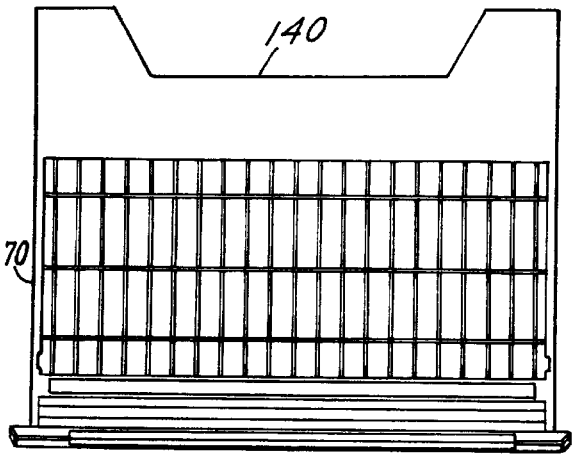
FIG. 18
FIG. 21
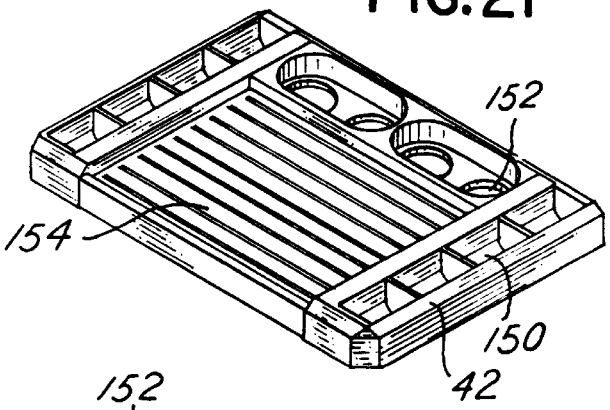
FIG. 19
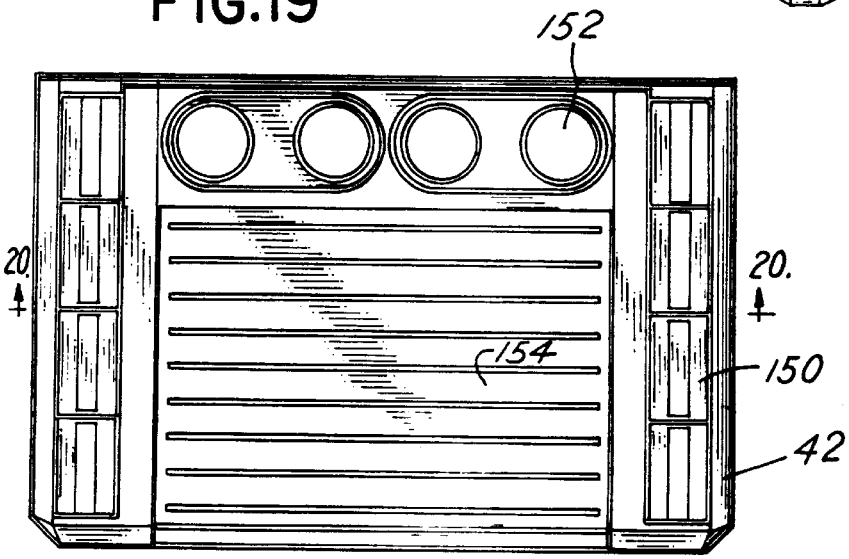
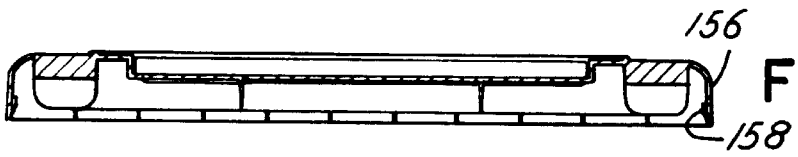
FIG. 20

TOOL CABINET

BACKGROUND OF THE INVENTION

This invention relates to a tool cabinet, and more particularly to a cabinet construction which includes a mechanism for locking the drawers of the cabinet while permitting open drawers to be easily moved to a closed and locked position.

Typically mechanics store their tools in a multiple drawer tool cabinet having a separate tool chest positioned or supported on the top of the cabinet. In this manner, when repairing a vehicle, for example, the tool chest and cabinet may be moved about as a unitary unit to the most convenient position relative to the vehicle. Access to the cabinet as well as the chest sitting upon the cabinet is then easily accomplished. Further, the tool chest may be portable and may thus be easily moved to a separate station for use by the mechanic, for example.

The described cabinet and chest are especially useful in a vehicle repair facility. However, home craftsmen often do not wish to have a separate tool cabinet and tool chest. Rather, they may desire to store all tools in a single easily accessible and portable cabinet. Home craftsmen also often desire to have the capability of locking their tools safely in such a cabinet. They also prefer to have storage capability that may be distinct from that of an auto mechanic by way of example. For example, the home craftsman may wish to have numerous additional small storage compartments for storing not only tools but also fasteners, drill bits, etc. Thus there has developed the need for a home storage cabinet having a generally modular shape, which is mobile, which has relatively good security features, which has a rugged construction, and which also includes a work surface as well as surface compartments for storage of tools and other items.

Additionally, the cabinet should include a means for locking so that the tools will be maintained in a secure fashion. Further, a locking mechanism is desired which will enable open drawers to be easily closed and maintained in a closed and locked condition. Further, there is a desire to have a tool cabinet and drawer combination wherein a cabinet lock is positioned in an unobtrusive place which enables easy access to the lock and which enables the cabinet to be locked even though various drawers remain open.

SUMMARY OF THE INVENTION

In a principal aspect, the present invention comprises a cabinet and drawer construction which includes a drawer catch positioned on the back side of a sliding drawer. The catch is cooperative with a retaining bar or strike positioned on the inside back wall of the cabinet. The catch includes a cam surface which coacts with or is cooperative with a locking bar. The cam surface guides the locking bar when the drawer is being closed to a position which enables the locking bar to retain the drawer in the closed condition until released. The subject matter of the invention thus comprises an improvement in a drawer catch construction of the type generally disclosed in U.S. Pat. No. 5,435,640 issued Jul. 25, 1995 and incorporated herein by reference. The cabinet of the invention further includes a lock which is arranged in a chamfered edge of the cabinet so that the lock may be easily oriented for actuation of the lock bar and also may be easily accessible for locking and unlocking the cabinet when the drawers are open and closed. The cabinet construction further includes a number of desirable features including small and replaceable compartments for tools, fasteners and other items; a handle construction which is adapted to receive a utility cord; a top construction which may be used as a work surface; and an optional slide tray which may be used as a work surface.

Thus it is an object of the invention to provide an improved cabinet and drawer construction having multiple drawers capable of being locked by a locking bar retained within the cabinet and operable by a key actuated mechanism.

A further object of the invention is to provide an improved cabinet and drawer construction which is portable, which has a modular drawer construction and which is especially adapted for use by home craftsmen.

Yet another object of the invention is to provide an improved cabinet and drawer construction which is capable of incorporating more than one set of vertical drawers wherein a lock mechanism associated with the sets of drawers is interconnected.

Yet another object of the invention is to provide a drawer and cabinet construction which is easy to manufacture, economical to repair, which is rugged and not costly.

These and other objects, advantages and features of the invention will be set forth in a detailed description which follows.

BRIEF DESCRIPTION OF THE DRAWING

In the detailed description which follows, reference will be made to the drawing comprised of the following figures:

FIG. 11 is a top plan view of a side handle attached to the cabinet of the invention;

FIG. 12 is a side elevation of the handle of FIG. 11;

FIG. 13 is a cross section of the handle of FIG. 12 along the line 13—13;

FIG. 14 is an isometric view of the handle of FIG. 11;

FIG. 15 is a top plan view of a compartment which may be attached to the drawer handle of FIG. 7;

FIG. 16 is an elevation view of the compartment of FIG. 15;

FIG. 17 is a cross sectional view of the compartment of FIG. 16 taken along the line 17—17;

FIG. 18 is a top plan view of a slidable shelf incorporated in the combination of the invention;

FIG. 19 is a top plan view of the top shelf assembly incorporated in the combination of the invention;

FIG. 20 is a cross-sectional view of the shelf of FIG. 19 taken along the line 20—20;

FIG. 21 is an isometric view of the shelf of FIG. 19;

DESCRIPTION OF THE PREFERRED EMBODIMENT

Figure 22:
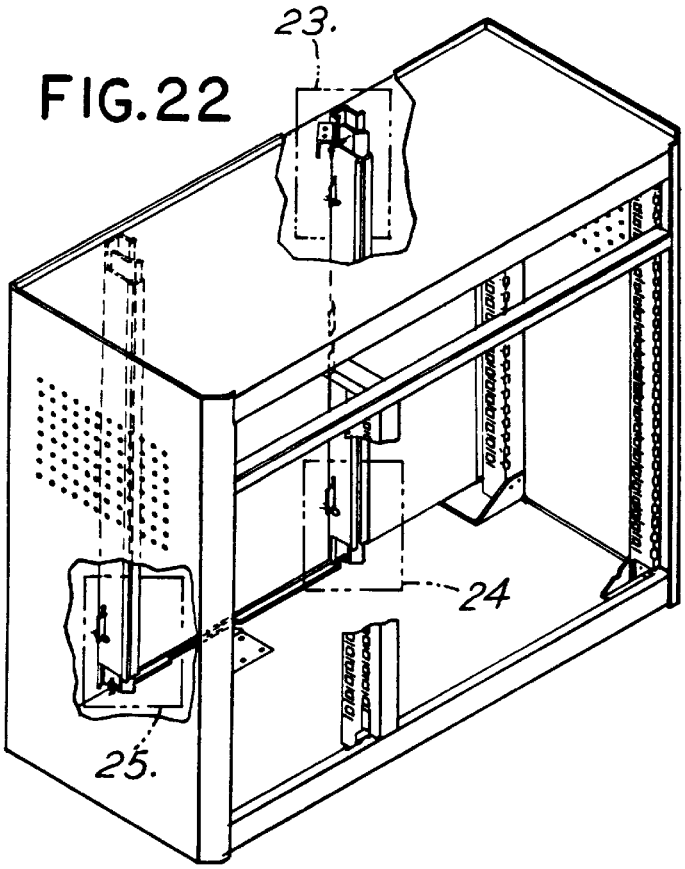
FIG. 22 is an isometric view of an alternative cabinet construction incorporating two vertical sets of drawers.
Figure 23:
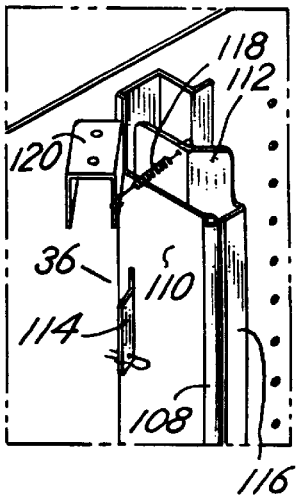
FIG. 23 is an enlarged perspective view of a locking mechanism or locking bar for drawers mounted on the back wall of the cabinet of FIG. 22.

The combination cabinet and drawers of the invention is disclosed with respect to two general embodiments. FIGS. 1–21 relate to a first embodiment which is comprised of drawers mounted in a cabinet with a slidable plastic shelf intermediate the drawers. The shelf slides horizontally and may provide a work surface. The top of the cabinet includes a molded plastic tray which is designed to hold various items and to provide as a work surface. In FIG. 22, and the remaining figures, a cabinet for a second embodiment of an invention, which includes two vertical sets of drawers, is illustrated. Each set of drawers includes a locking bar associated therewith. In the following description, therefore, emphasis will be initially directed to the embodiment depicted in FIG. 1 having a single set of drawers. Discussion will then be directed to the parallel sets of vertical drawers represented by FIG. 22, although the locking mechanism associated with both embodiments is substantially similar and thus reference will be made to all of the figures with respect to the locking mechanism for the described cabinets.

It is noted that the cabinet construction is especially directed to a home craftsman, although any craftsman or mechanic or other worker may utilize the cabinet and drawer combination. The use by a home craftsman is facilitated by the provision of numerous separate compartments into which various smaller items such as nails, fasteners, and small tools may be stored. Additionally the side handle of the cabinet is designed to receive a cord, such as an electrical cord, for storage. Such features are believed to enhance the desirability of the cabinet construction for use by home craftsmen.

Figure 1:
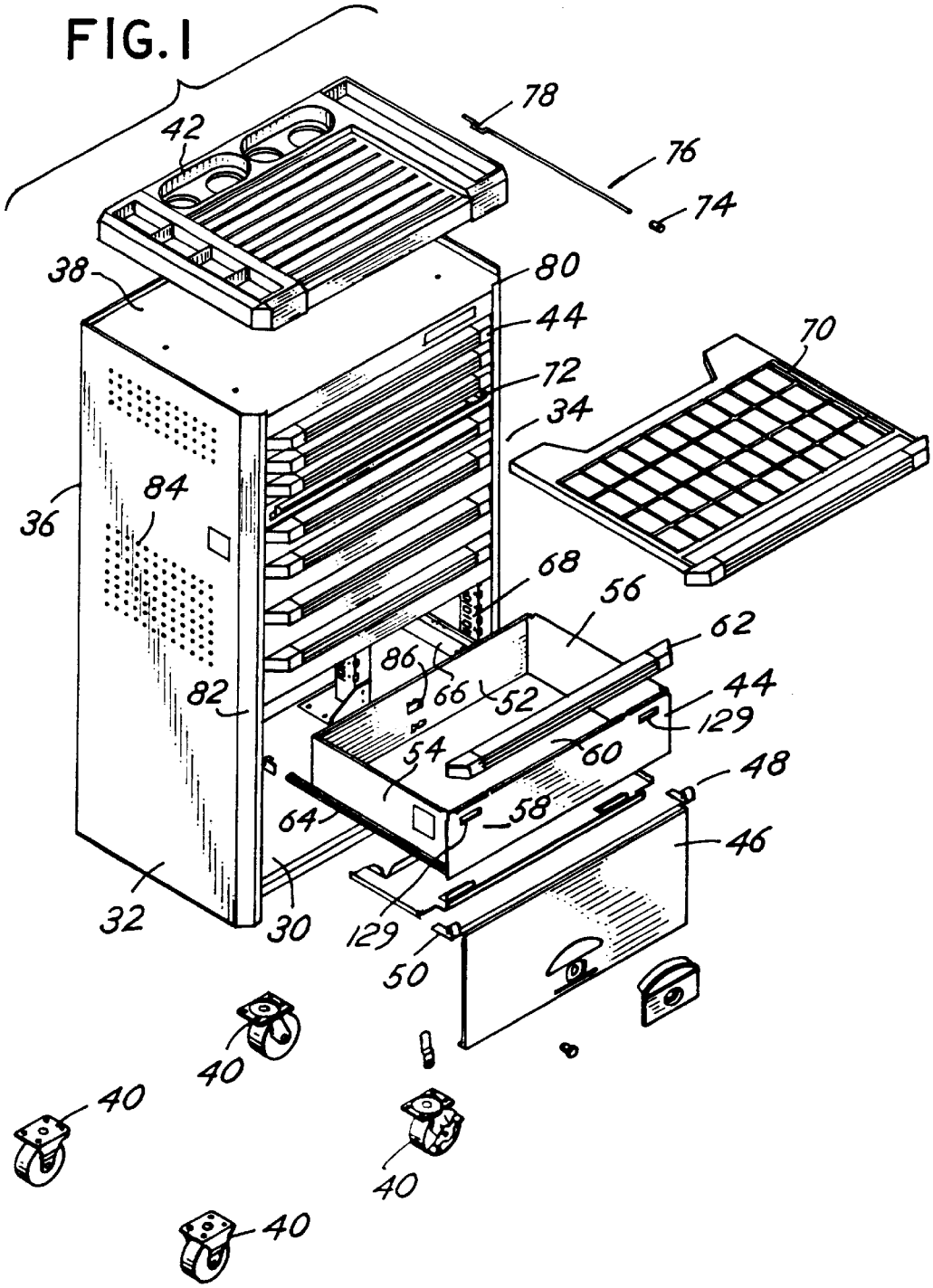
FIG. 1 is an exploded isometric view of an embodiment of the invention.

Referring to FIG. 1, the construction of the invention includes a cabinet having a base or bottom wall 30, a first sidewall 32, a second sidewall 34, a back wall 36, and a top wall or surface 38. The walls 30, 32,34,36,38 are joined together to form a cabinet enclosure with a front opening. Casters, such as casters 40, are mounted on the bottom wall or bottom surface 30 to enhance the mobility of the formed cabinet. The cabinet further includes a molded plastic top tray 42, described in greater detail below. A series of drawers 44 are slidably mounted through the front opening of the cabinet, and a lower pivotal storage panel 46 permits access to an open storage area adjacent the bottom wall 30 of the cabinet. The panel 46 is pivotal on hinge pins 48 and 50 and slidable into a track that recedes into the cabinet for access to the interior of the cabinet. The drawers 44 typically include a back side 52, a first lateral side 54, a second lateral side 56, a front side 58 and a bottom side 60. A handle 62, which is described in greater detail below, fits across and attaches to the front side 58. Each drawer 44 is mounted on roller slides 64 which are arranged on each side of the drawer 44 and attached to the sidewalls or sides 54 and 56. The slides 64 mount in slide brackets 66 attached onto vertical support members 68 within the cabinet. The support members 68 include a series of modular openings to receive brackets at modular positions to permit spacing adjustment and thereby facilitate the inclusion of various sized drawers. A sliding shelf 70 fits within a slot or slide opening 72 in the front of the cabinet.

Figure 2:
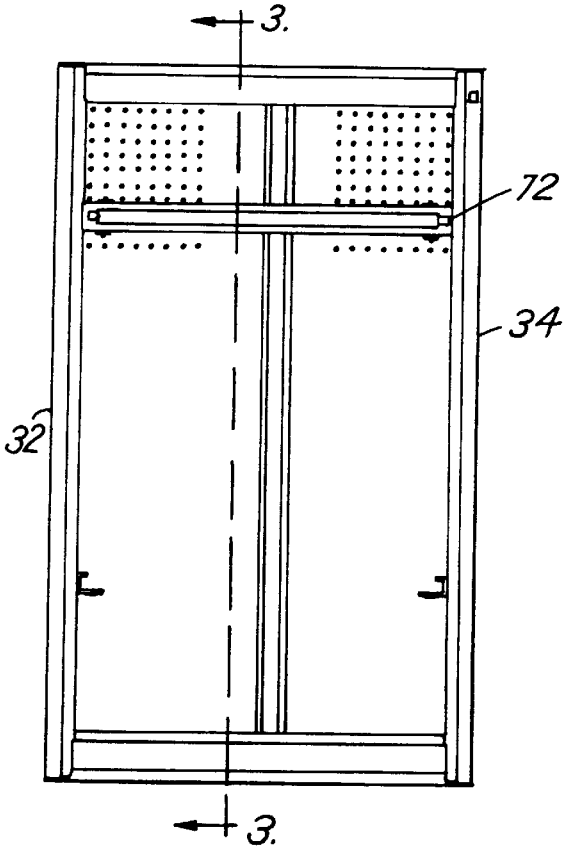
FIG. 2 is a front elevation of the cabinet for the combination of FIG. 1.
Figure 3:
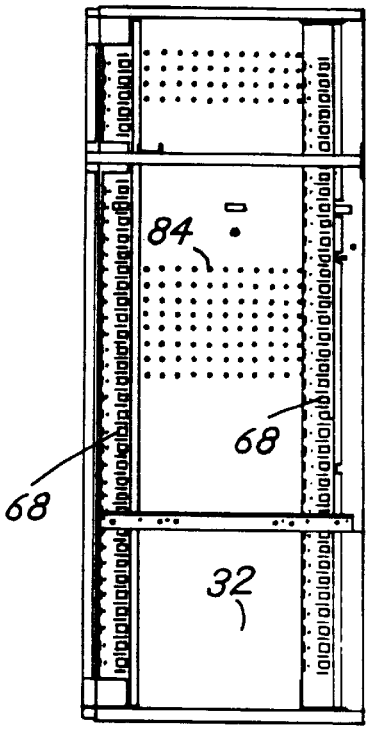
FIG. 3 is a cross section of FIG. 2 taken along the line 3—3.
Figure 4:
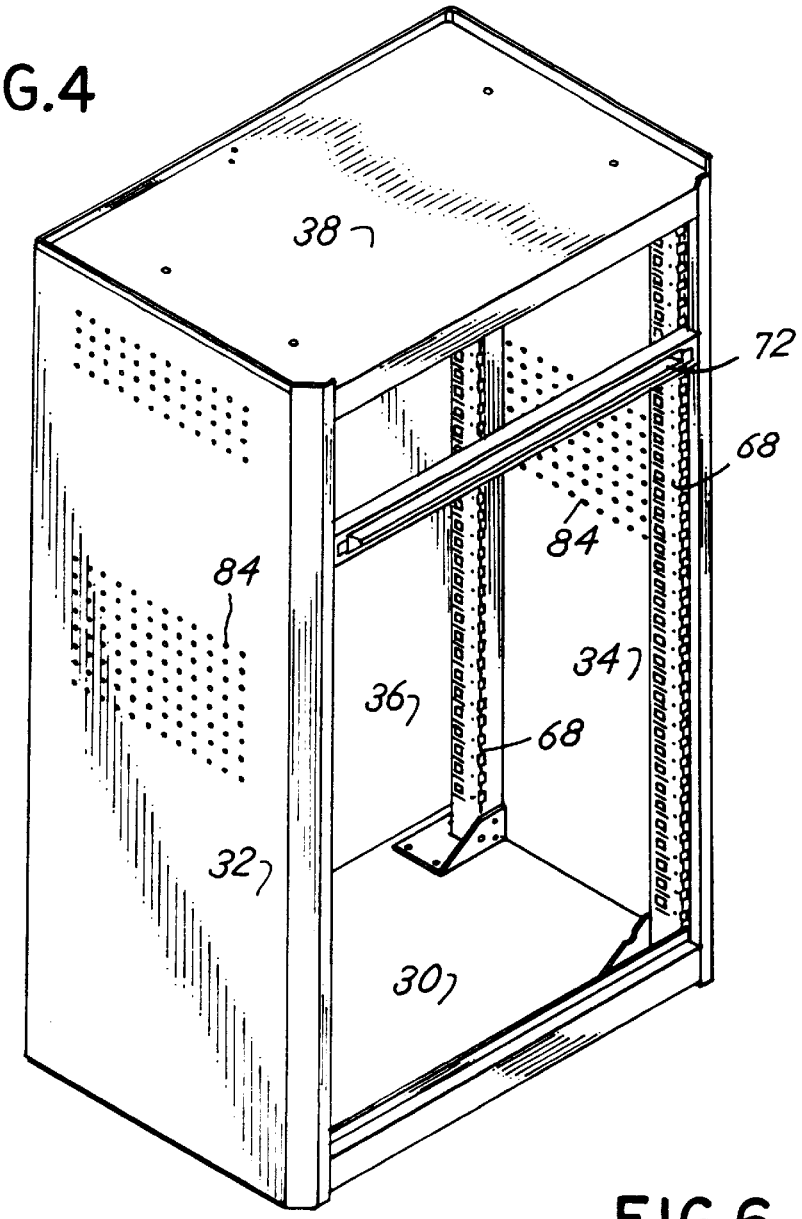
FIG. 4 is an isometric view of the cabinet of the combination of the invention.
Figure 5:
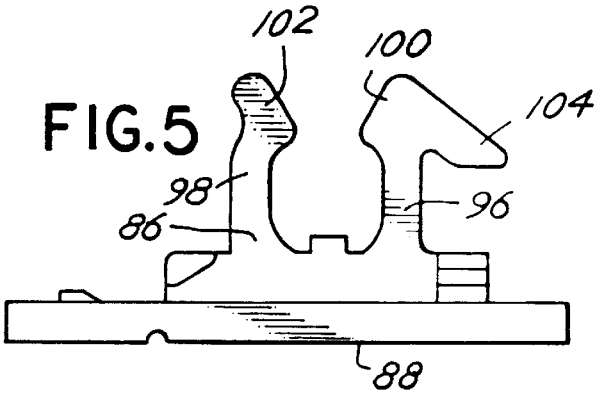
FIG. 5 is a top plan view of a drawer catch which is used in the combination of the invention.
Figure 6:
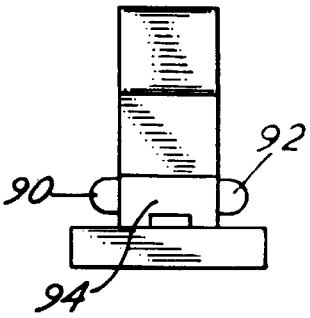
FIG. 6 is a side elevation of the drawer catch of FIG. 5.
Figure 10:
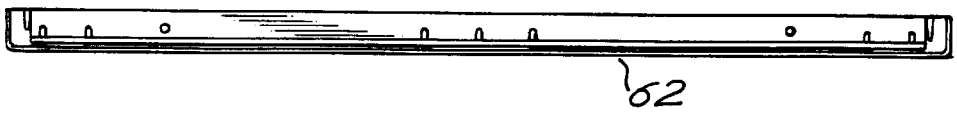
FIG. 10 is a back plan view of the handle of FIG. 7.
Figure 9:
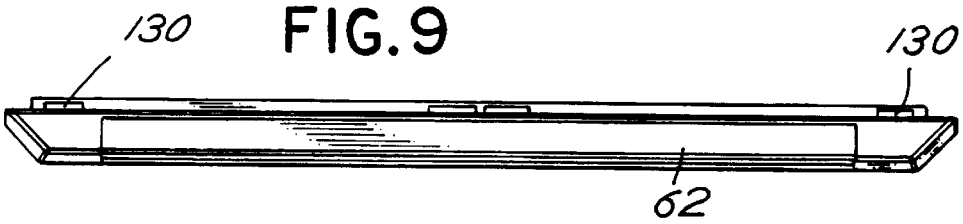
FIG. 9 is a top plan view of the handle of FIG. 7.
Figure 8:
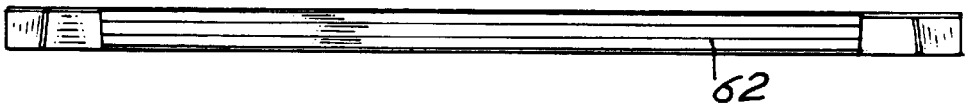
FIG. 8 is a front plan view of the handle of FIG. 7.
Figure 7:
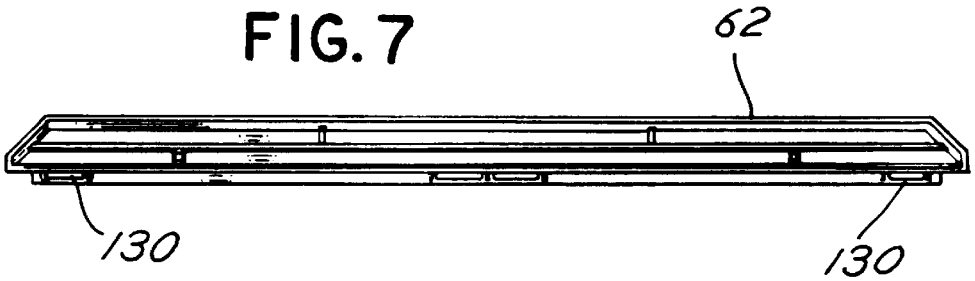
FIG. 7 is the bottom plan view of a drawer handle used in the combination of the invention.

The cabinet further includes a cylinder lock 74 which actuates a control rod 76 having a bend or cam driving section 78 described in greater detail below. The cylinder lock 74 is mounted in a chamfered side surface 80 connecting the sidewall 34 with the front cabinet opening. A similar chamfer surface 82 is provided on the opposite side of the cabinet adjacent sidewall 32. The sidewalls 32 and 34, as well as the back wall 36, all include an array of perforations or openings 84. The openings 84 are adapted to receive pegboard type tool holders which may be inserted through the openings 84 to hold tools and the like. FIGS. 2–4 depict in greater detail the described components.

The back or rear side 52 of each drawer 44 includes a catch 86. The catch 86 is similar to the catch depicted and described in U.S. Pat. No. 5,435,640 with some additional features as described in greater detail below. Thus the catch 86, as depicted in FIGS. 5, 6, 26, 27 and 28 is made from elastomeric material and includes a base 88 with projecting locking tabs 90 and 92 which extend from the body 94 of the catch 86. Spaced elastomeric arms 96 and 98 define gripping jaws 100 and 102 positioned at the end of arms 96 and 98. The catch 86 also includes a lateral leg 104 which projects from one side of the arm 96 and is designed to cooperate with a locking bar described below. The catch 86 is inserted through an opening in the back side 52 of a drawer 44 and retained by tabs 90, 92. The jaws 100 and 102 may engage with a strike or shaped bar in a manner taught in the previously incorporated U.S. Pat. No. 5,435,640. The laterally projecting rib or leg 104 is adapted to be engaged by a locking bar or locking flange.

FIGS. 22–28 illustrate, in greater detail, the construction of the locking bar or flange. Thus, the jaws 100, 102 of catch 86 are designed to engage with a rib 108 which extends along the edge of a vertical strike bar 110. The jaws 100 and 102 fit over the strike 108 to hold drawer 44 in a closed condition. A pivotal locking bar 112 is mounted by hinge extensions 114 on strike 108. Extensions 114 pass through slots in the plate 110. The locking bar 112 includes a flange 116 which, when the catch 86 is in the closed position and fitted onto strike 108, may be positioned behind the leg or tab 104 to hold a drawer 44 in a locked or non-release condition so long as the bar 112 maintains its biased closed condition by actuation of a spring 118 connected between the bar 112 and a bracket 120 attached to the top wall 38 of the cabinet.

The actuator rod 76, which may be driven by the cylinder lock 74, connects between the cylinder lock 74 and the bracket 120. The rod 76 is adapted to position the cam bend 78 to interact or engage with the locking bar 112. When the assembly is in the locked condition of FIG. 28, the cam bend 78 is disengaged from or turned to a position to release the bar 112 for engagement with the leg 104 of closed drawers 44. The drawers 44 may be unlocked by rotation of the actuator rod 76 causing the cam 78 to engage the locking bar 112 thereby removing the flange 116 from engagement with the leg 104 as in FIGS. 26 and 27. This permits one to open the drawers 44 by manually pulling the drawer 44 to disengage the catch 86 from strike 108.

Figure 24:
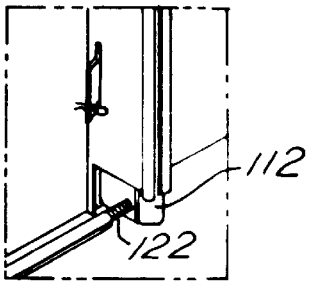
FIG. 24 is an enlarged perspective view of the locking bar construction incorporated in a cabinet f the type depicted in FIG. 22.
Figure 25:
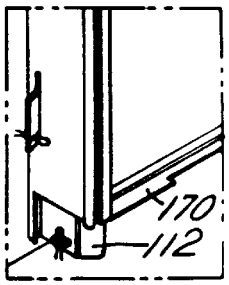
FIG. 25 is an enlarged perspective view of the connecting linkage between adjacent and parallel locking bars in a cabinet construction of the type depicted in FIG. 22.
Figure 26:
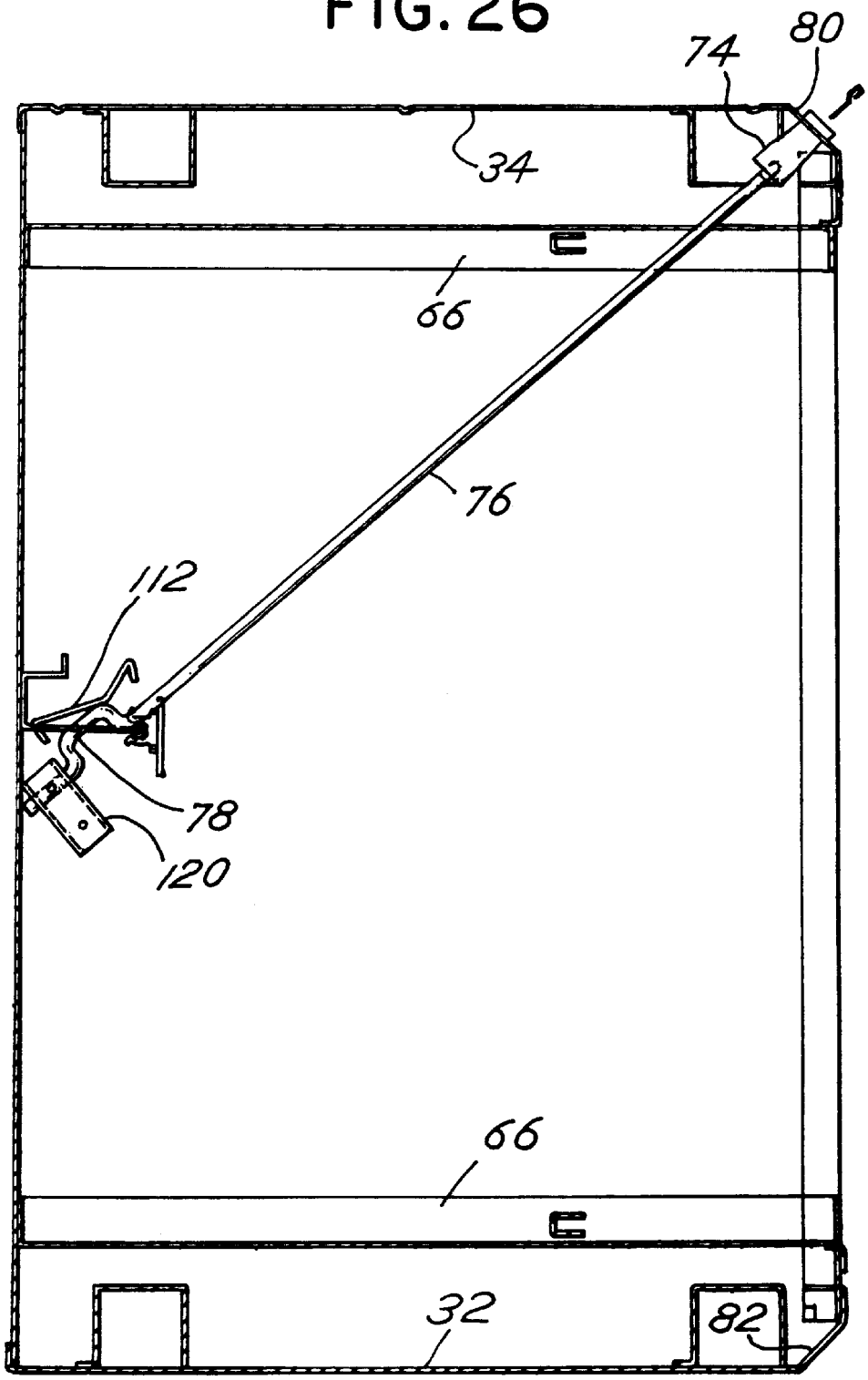
FIG. 26 is a plan view of a cylinder lock and actuator rod for the locking bar of FIG. 25.
Figure 27:
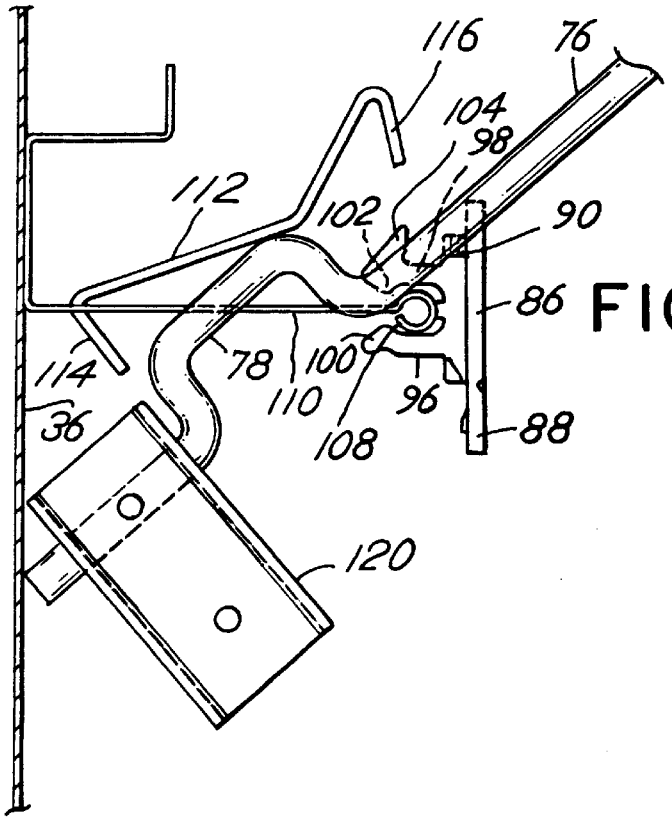
FIG. 27 is an enlarged plan view of the drawer catch, locking bar and actuator of FIG. 25 in the unlocked position.
Figure 28:
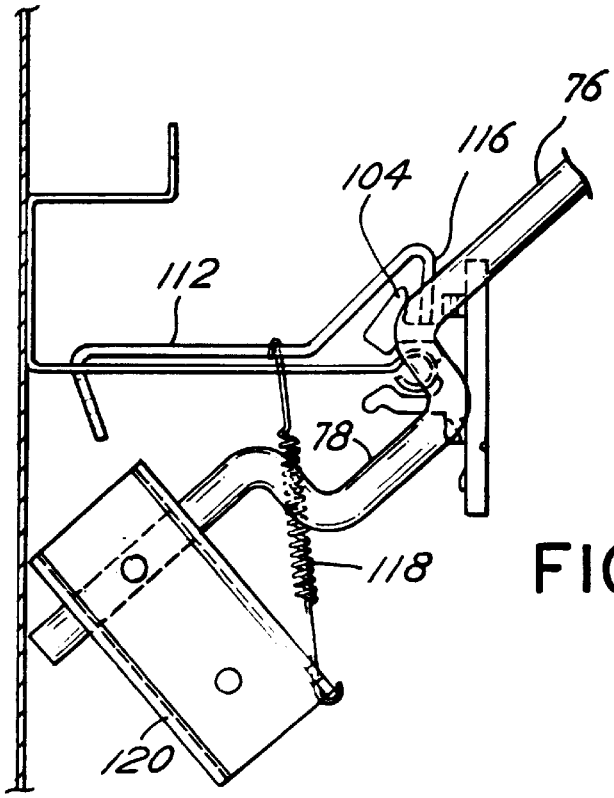
FIG. 28 is an enlarged plan view similar to FIG. 27 in the locked position.

FIGS. 24 and 25, as well as FIG. 22, illustrate the construction wherein two sets of vertical drawers, arranged in side-by-side array, are provided in a cabinet. In such construction, the lower ends of each locking bar 112 are connected by a link 120. Link 120 includes a compression spring member 122 that provides a lost motion feature. That is, locking bars 112 associated with each of the vertical sets of drawers 44 may be independently pivoted by virtue of closing a drawer 44 without affecting or unlocking the adjacent set of drawers because of the lost motion feature associated with the spring 122 that is incorporated in the linkage between the locking bars 112. Closing a drawer 44 thus pivots a locking bar 112 temporarily as the cam leg 104 moves the bar 112 about its pivot axis. Simultaneously, spring 122 is compressed so that the adjacent bar 112 is not pivoted. The spring 122 will next expand as the displaced bar 112 pivots to its closed position engaging leg 104 of closed drawer 44.

Referring now to FIGS. 7–10 and 15–17, there is depicted a typical front handle 62 and some associated compartments which may cooperate with a handle 62. The handle 62 is depicted in FIGS. 7–10. A compatible compartment or article holder construction is depicted in FIGS. 15–17. The handle 62 is designed to fit across the full front face of a drawer 44. The handle 62 includes projecting support tab springs 130 which fit through openings 129 in the front side 58 of a drawer 44. Those support tab openings 29 are designed to receive support hangers 132 associated with a molded compartment 134. In this manner, the holder or compartment 134 may be suspended on the inside of drawer 44. Note that the hangers 132, as shown in FIG. 17, fit through appropriate holder openings 130 of the handles 62 and that a support leg 136 is molded to the compartment 134 to properly orient and space the compartment 134 from the inside surface of the front side 58.

FIGS. 11–13 and 14 depict handle 91 which may be attached to the midpoint of a side 34 of the cabinet. The handle 91 includes a cross member 93 connected by extensions 95 and 97 to the cabinet. A center extension 99 includes through passages 101 and 103 adapted to receive tools such as a screwdriver or pliers. Formed webs or compartments 105 and 107 are provided intermediate the connection extensions 97, 99 and 95, 99 and are utilized for holding items. For example, nails, drill bits or the like may be stored in such compartments 105 and 107. The connection extensions 95 and 97 are offset inwardly at the ends of the handle 93 so that the handle 93 and connections or extensions 95 and 97 serve as a means for wrapping an extension cord or the like around the handle construction of FIGS. 11–13. Thus, the cabinet, which is mounted on rollers, may be moved by grasping the handle 93. The handle 93 may also be used as a supplementary storage device.

FIG. 18 depicts a slide tray 70. It is noted that the slide tray 70 includes a V-notch 140 in its back side to accommodate the locking bar 112 and other mechanisms previously described mounted on the back inside surface of the back side or back wall 36 of the cabinet.

FIGS. 19, 20 and 21 depict the top tray 42 which fits over the top wall 38. The top tray 42 may include a series of molded compartments 150 and 152, for example, as well as a work surface 154. The top tray 42 further includes side flanges 156 as depicted in FIG. 20 with locking tabs 158 that are designed to engage with openings in the sides 36 and 34 of the cabinet to hold the tray 42 in a locked position on the cabinet. Since the side flanges 156 are flexible, however, the tray 42 may be released from engagement with the cabinet construction.

It will be seen that the cabinet construction may be made in various heights and widths with one or more vertical rows of drawers. The drawers are locked by a locking construction which permits open drawers to be closed and locked. The lock 74 is positioned in the chamfered wall intermediate a side wall and front opening and provides a means to disengage the locking bar while permitting full access to the front side of the drawers. The chamfered wall typically forms a 45° angle with a side wall. However, the angle may be varied to orient the mid axis of the lock 74 with the midpoint of the back wall of the cabinet and the locking bar 112. Other desired orientations are appropriate to provide an efficient locking mechanism. The various compartments and combinations of drawers may be altered without departing from the spirit and scope of the invention. The invention is to be therefore limited only by the following claims and equivalents.

What is claimed is:

1. A portable tool storage cabinet and drawers comprising, in combination:

said cabinet including a base;

a back wall;

first and second opposite sidewalls;

a top wall, said walls and base defining an enclosure with a front opening;

said drawers including a plurality of drawers slidably mounted in the front opening of the cabinet enclosure and having a closed position;

each of said drawers having lateral sides and a back side, said lateral sides each including slide mountings and at least one of said drawers further including a catch extending from the back side thereof;

said back wall of said cabinet including a strike positioned to be engaged by the catch extending from the back side of the drawer having a catch when said drawer is in said closed position in the cabinet;

said catch comprising an elastomeric member with elastomeric legs for engaging and gripping the strike, and said catch further including a cam surface and a locking rib extending from one leg thereof;

said back wall of said cabinet including a vertical locking bar pivotal between a locking position for engagement with the locking rib of said catch when the associated drawer is in the closed position and an unlocking position; and a biasing member for biasing the locking bar to said locking position.

2. The combination of claim 1 further including a lock mounted in the cabinet for locking the locking bar in the locking or unlocking position, said lock including an actuator for engaging and pivoting the locking bar.

3. The combination of claim 2 wherein the cabinet includes a chamfer surface intermediate one of said cabinet sidewalls and the front opening, said lock comprising a cylinder lock mounted in the chamfer surface and including said actuator connecting the lock to a bracket at the back side of the cabinet, said actuator rotatable to move the lock bar between the locking and unlocking position.

4. The combination of claim 1 further including at least one exterior handle on one sidewall, said handle including a manual cross member, projecting ends, opposite end connecting brackets for attaching the handle to the said one sidewall inward of the ends to define a wound cord holder.

5. The handle of claim 4 further including at least one tool support recess in the handle.

6. The combination of claim 1 wherein at least one of said drawers includes a front wall of lesser height than the lateral walls thereof, and further including a drawer handle fitted in the space along the top edge of the said front wall and projecting inwardly for support of one or more retainer compartments.

7. The combination of claim 1 further including modular perforations in at least one cabinet sidewall.

8. The combination of claim 1 further including roller slide mountings for the drawers and vertical support brackets in the cabinet for supporting the slide mountings.

9. The combination of claim 8 wherein the vertical support brackets include modular connections for the roller slide mountings.

10. The combination of claim 1 including at least two side-by-side sets of drawers in one cabinet, each set having a strike, locking bar and catches for the associated drawers.

11. The combination of claim 10 including a link connecting the locking bars, said link including an element to permit independent rotation of each locking bar about its pivot axis.

12. The combination of claim 1 further including a sliding work shelf mounted for sliding storage in the cabinet from the front opening.

13. A tool cabinet construction including a cabinet and drawers, said construction comprising in combination:

said cabinet having a bottom wall, a top wall, first and second spaced sidewalls, a back wall and an open front to define an enclosure having an open front;

a plurality of said drawers arranged in vertical array and each drawer slidably mounted to the cabinet sidewalls and accessible through the open front;

a chamfered wall intermediate the open front and one of said first and second sidewalls of the cabinet;

a cylinder lock mounted in the chamfered wall and including an actuator extending into the cabinet enclosure, a locking mechanism located on the inside of the back wall of the cabinet generally midway between the cabinet sidewalls; and said cylinder lock actuator extending to and connected with the locking mechanism for actuating the locking mechanism between an unlocked and locked condition.

14. The construction of claim 13 wherein the actuator comprises a rod member connected between the cylinder lock and a bracket mounted on one of said walls of said cabinet, said rod member comprising a generally straight line connection from the cylinder lock to the bracket.

15. The construction of claim 14 wherein the rod member includes a bend which defines an actuator cam for operating the locking mechanism.

16. The construction of claim 13 wherein the chamfered wall forms an angle of approximately 45° with its adjacent sidewall and forms a continuous extension of said adjacent sidewall.

* * * * *

UNITED STATES PATENT AND TRADEMARK OFFICE

CERTIFICATE OF CORRECTION

PATENT NO.: 6,109,709

DATED: August 29, 2000

INVENTOR(S): Holcomb et al.

It is certified that errors appear in the above-identified patent and that said Letters Patent is hereby corrected as shown below:

On the title page, item [75]Inventors:

Carl E. Hofrfmeyer should read CARL E. HOFFMEIER.

Column 3, line 5 reads "a cabinet f" and should read --a cabinet of--.

Column 5, line 29 reads "tab openings 29" and should read --tab openings 129--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*